US011268515B2

(12) United States Patent
Miller et al.

(10) Patent No.: US 11,268,515 B2
(45) Date of Patent: Mar. 8, 2022

(54) TURBOPUMP WITH AXIALLY CURVED VANE

(71) Applicant: Aerojet Rocketdyne, Inc., Sacramento, CA (US)

(72) Inventors: Jeff Miller, Simi Valley, CA (US); Saleh Tyebjee, Sacramento, CA (US); Thaddeus Chilcoat, Moorpark, CA (US); Steven Grota, Simi Valley, CA (US)

(73) Assignee: AEROJET ROCKETDYNE, INC., Canoga Park, CA (US)

( * ) Notice: Subject to any disclaimer, the term of this patent is extended or adjusted under 35 U.S.C. 154(b) by 410 days.

(21) Appl. No.: 15/312,720

(22) PCT Filed: Jun. 29, 2015

(86) PCT No.: PCT/US2015/038230

§ 371 (c)(1),
(2) Date: Nov. 21, 2016

(87) PCT Pub. No.: WO2016/007317

PCT Pub. Date: Jan. 14, 2016

(65) Prior Publication Data

US 2017/0184109 A1 Jun. 29, 2017

Related U.S. Application Data

(60) Provisional application No. 62/022,279, filed on Jul. 9, 2014.

(51) Int. Cl.

| | |
|---|---|
| ***F04D 1/04*** | (2006.01) |
| ***F04D 29/44*** | (2006.01) |
| ***F01D 5/08*** | (2006.01) |

(52) U.S. Cl.

CPC ..... *F04D 1/04* (2013.01); *F01D 5/087* (2013.01); *F04D 29/44* (2013.01); *F04D 29/448* (2013.01); *F05D 2250/52* (2013.01)

(58) Field of Classification Search

CPC ..... F04D 1/04; F04D 29/24; F04D 29/242; F04D 29/30; F04D 29/44; F04D 29/448

(Continued)

(56) References Cited

U.S. PATENT DOCUMENTS

| | | | | |
|---|---|---|---|---|
| 3,093,084 A | | 6/1963 | Derderian | |
| 3,203,354 A | * | 8/1965 | Haakon | F04D 9/003 415/112 |

(Continued)

FOREIGN PATENT DOCUMENTS

| | | |
|---|---|---|
| DE | 149525 | 1/1903 |
| EP | 2495444 | 9/2012 |

(Continued)

OTHER PUBLICATIONS

International Preliminary Report on Patentability for International Application No. PCT/US2015/038230 dated Jan. 10, 2017.

(Continued)

*Primary Examiner* — Woody A Lee, Jr.
*Assistant Examiner* — Jesse M Prager

(57) ABSTRACT

A turbopump includes an impeller (22) that is rotatable about an axis (A). A discharge collector (28) is located radially outward of the impeller. A passage (30) fluidly connects the impeller to the discharge collector. The passage is curved.

13 Claims, 2 Drawing Sheets

(58) Field of Classification Search
USPC ..... 415/58.2
See application file for complete search history.

(56) References Cited

U.S. PATENT DOCUMENTS 3,612,714 A * 10/1971 Ruspino ..... A47L 15/4225 134/186
3,861,826 A * 1/1975 Dean, Jr. ..... F04D 29/444 415/208.4
3,904,312 A * 9/1975 Exley ..... F04D 29/44 415/181
3,910,714 A * 10/1975 Allen ..... F04D 7/065 415/108
4,152,092 A * 5/1979 Swearingen ..... F01D 11/02 277/423
4,749,332 A * 6/1988 Coffinberry ..... F02C 7/224 415/143
4,865,519 A 9/1989 Liu et al.
5,277,541 A * 1/1994 Palmer ..... F04D 29/4213 415/206
5,427,498 A * 6/1995 Lehe ..... F04D 29/167 415/106
2003/0235497 A1* 12/2003 Meng ..... F04D 29/444 415/208.3
2011/0008150 A1* 1/2011 Mazzouji ..... F01D 5/048 415/58.2
2015/0159664 A1* 6/2015 Olin ..... F02C 7/045 415/58.2

FOREIGN PATENT DOCUMENTS

FR 2422053 11/1979
GB 1283696 A * 8/1972 ..... F04D 29/44
JP H11173296 6/1999

OTHER PUBLICATIONS

International Search Report for International Application No. PCT/US2015/038230 completed Aug. 27, 2015.

* cited by examiner

TURBOPUMP WITH AXIALLY CURVED VANE

CROSS-REFERENCE TO RELATED APPLICATION

The present disclosure claims priority to U.S. Provisional Patent Application No. 62/022,279, filed Jul. 9, 2014.

BACKGROUND

A typical turbopump may include a turbine and an impeller mounted on a common shaft. The turbine drives the impeller to pump or pressurize a fluid, such as a liquid propellant. The impeller discharges the fluid through a radial passage into a pump collector.

SUMMARY

A turbopump according to an example of the present disclosure includes an impeller rotatable about an axis, a discharge collector, and a passage that fluidly couples the impeller to the discharge collector. The passage includes a vane that is curved in the direction of the axis.

In a further embodiment of any of the forgoing embodiments, the impeller has an inlet side, and the vane is curved toward the inlet side.

In a further embodiment of any of the forgoing embodiments, the discharge collector has a flat side, and the passage opens into the discharge collector at the flat side.

In a further embodiment of any of the forgoing embodiments, the discharge collector has a symmetry with respect to a line of symmetry that intersects the vane.

In a further embodiment of any of the forgoing embodiments, the vane includes a leading edge at the impeller and a trailing edge at the discharge collector, and the vane diverges from the leading edge to the trailing edge.

In a further embodiment of any of the forgoing embodiments, the vane includes a leading edge at the impeller and a trailing edge at the discharge collector, and the trailing edge is flush with an interior surface of the discharge collector.

In a further embodiment of any of the forgoing embodiments, the vane includes a leading edge at the impeller and a trailing edge protruding into the discharge collector.

In a further embodiment of any of the forgoing embodiments, there is a radial direction perpendicular to the axis, and the vane is curved up to 45° with respect to the radial direction.

In a further embodiment of any of the forgoing embodiments, the vane is a diffuser vane.

In a further embodiment of any of the forgoing embodiments, the vane is a guide vane.

A turbopump according to an example of the present disclosure includes an impeller that is rotatable about an axis, a discharge collector radially outwards of the impeller, a passage including an inlet that opens to the impeller and an outlet that opens to the discharge collector, with a vane in the passage. The vane includes, relative to the axis, a radially inner leading edge at the inlet and a radially outer trailing edge at the outlet, and the radially outer trailing edge is axially offset from the radially inner leading edge.

In a further embodiment of any of the forgoing embodiments, the radially outer trailing edge is axially offset from the radially inner leading edge by up to 45°.

In a further embodiment of any of the forgoing embodiments, the radially outer trailing edge is axially offset from the radially inner leading edge by equal to or less than 30°.

In a further embodiment of any of the forgoing embodiments, the discharge collector has a flat side, and the passage opens into the discharge collector at the flat side.

In a further embodiment of any of the forgoing embodiments, the impeller has inlet side, and the radially outer trailing edge is axially offset toward the inlet side.

In a further embodiment of any of the forgoing embodiments, the vane diverges from the radially inner leading edge to the radially outer trailing edge.

In a further embodiment of any of the forgoing embodiments, the radially outer trailing edge is flush with an interior surface of the discharge collector.

A turbopump according to an example of the present disclosure includes an impeller rotatable about an axis, a discharge collector, and a passage that fluidly couples the impeller to the discharge collector. The passage includes a vane that is inclined relative the axis.

In a further embodiment of any of the forgoing embodiments, the vane is inclined at an angle of inclination of greater than 45°.

In a further embodiment of any of the forgoing embodiments, the impeller has inlet side, and the vane is inclined toward the inlet side.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
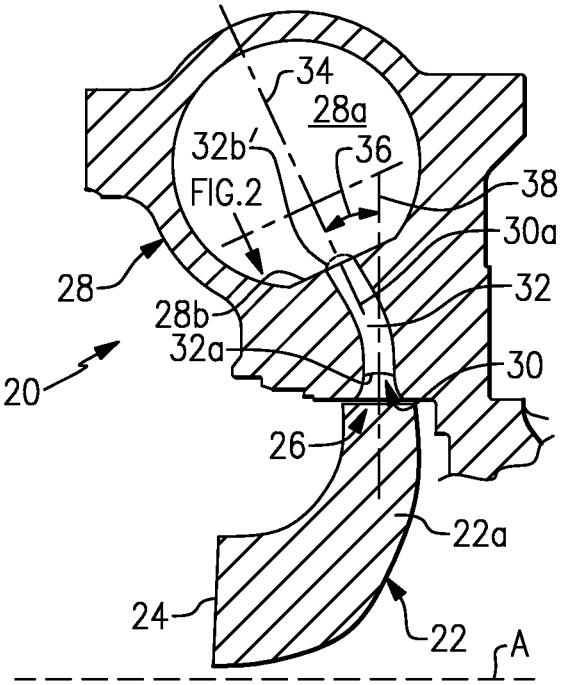
FIG. 1 illustrates an example turbopump that includes a vane that is axially curved.

FIG. 1 schematically illustrates selected portions of an example turbopump 20. As will be described, the turbopump 20 is relatively axially compact, yet still can provide good fluid dynamic performance and reduced stresses at certain locations described herein.

In this example, the turbopump 20 includes an impeller 22 that is rotatable about an axis A. As generally known, the impeller 22 may include a plurality of impeller blades 22*a*. The impeller 22 has an inlet side 24, at which fluid enters axially, and a radially-located outlet 26.

A discharge collector 28 is located radially outwards of the impeller 22. A passage 30 fluidly couples the impeller 22 to an interior 28*a* of the discharge collector 28. The passage 30 includes a vane 32 therein. For example, the vane 32 is a diffuser vane that serves to control flow or reduce flow velocity. Additionally or alternatively, the vane 32 can be a guide vane guide that serves for flow stability and/or structural support. As can be appreciated, a plurality of such passages 30 and vanes 32 can be provided in a circumferential arrangement. The vane 32 includes a radially inner leading edge 32*a* and a radially outer trailing edge 32*b*. The inner edge 32*a* is located at the impeller 22 and the outer edge 32*b* is located at the interior 28*a* of the discharge collector 28.

In this example, the vane 32 is curved in the direction of the axis A. For example, the vane 32 curves axially forward from the radially inner leading edge 32*a* toward the inlet side 24 of the impeller 22. In this regard, the trailing edge 32*b* is axially offset from the leading edge 32*a* such that the vane 32 is inclined relative the axis A of the impeller. Thus, the length-direction of the vane 32 is sloped with respect to the axis A. Although the vane 32 in this example curves axially from the leading edge 32*a* to the trailing edge 32*b*, in modified examples the trailing edge 32*b* could be axially offset from the leading edge 32*a* with the vane 32 being straight or curved to a lesser extent, although the curvature can facilitate better fluid dynamic performance.

Figure 2:
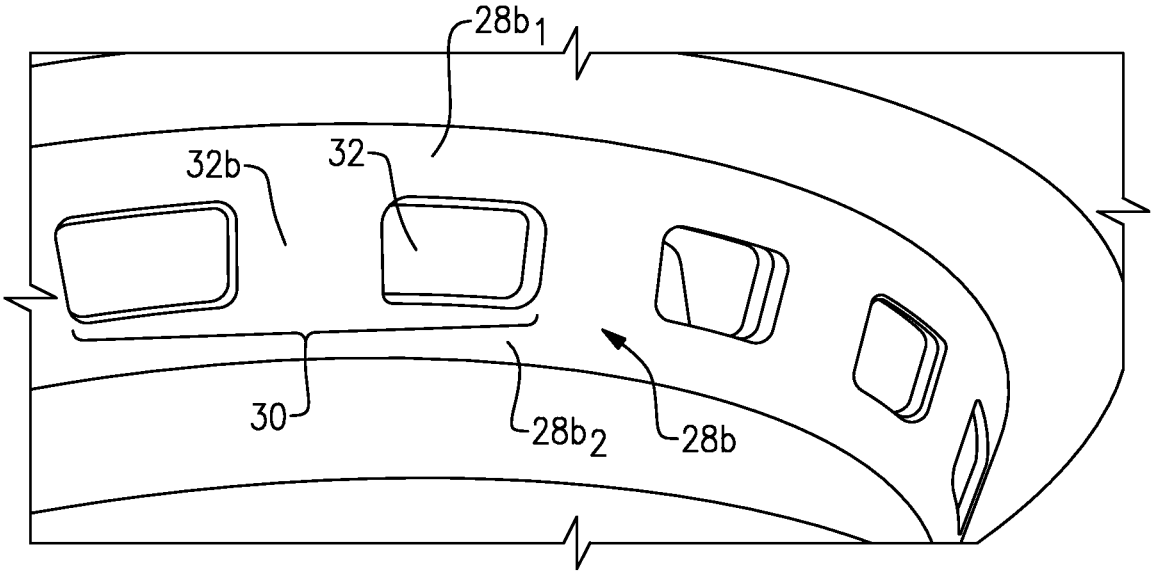
FIG. 2 is a sectional view of the turbopump of FIG. 1.

As also shown in FIG. 1, the interior 28*a* of the discharge collector 28 is generally round but includes a flat side 28*b* at which the passage 30 opens into the interior 28*a*. As shown in FIG. 2, the flat side 28*b* has first and second portions $\mathbf{28}b_1/\mathbf{28}b_2$ that flank the trailing edge 32*b* of the vane 32. In this example, the trailing edge 32*b* is flush with the flat side 28*b*, to reduce fillet area. As can be appreciated, the flat side 28*b* is flat in at least one linear dimension and overall is an annular, frustoconical surface with respect to the axis A. In one variation, the trailing edge protrudes into the interior 28*a* of the discharge collector 28, as represented at 32*b*'. This may provide a stress/fatigue benefit, thereby enhancing life.

In a further example, the discharge collector 28, and specifically the interior volume 28*a*, has a symmetry with respect to a line of symmetry 34. The line of symmetry 34 intersects the vane 30. For example, the vane 30 has a midpoint axis 30*a* that is coaxial with the line of symmetry 34 at the trailing edge 32*b* of the vane 32, and the line of symmetry 34 and the midpoint axis 30*a* are sloped with respect to the axis A.

In a further example, the passage 30, and thus the height of the vane 32 is uniform from the leading edge 32*a* to the trailing edge 32*b*, and there is a smooth, constant curvature between the leading edge 32*a* and the trailing edge 32*b*. The amount of curvature selected can influence the fluid dynamics of the fluid conveyed over the vane 32 through the passage 30 into the discharge collector 28, and thus a smooth curvature can provide smooth "turning" of the fluid with reduced pressure loss.

As an example, the amount of curvature can be represented by an angle 36 with respect to a radial direction 38 that is perpendicular to the axis A. For instance, the angle 36 is taken with respect to a reference point at the midpoint of the trailing edge 32*a* on the radial direction 38 and a second, corresponding reference point at the midpoint on the trailing edge 32*b*. Corresponding reference points could alternatively be selected at the top of the vane 32 or at the bottom of the vane 32, for example. The line intersecting the two reference points forms the angle 36 that represents the amount of curvature of the vane 32. For example, the angle 36 can be up to 45°. In further examples, the angle 36 is less than or equal to 30° or is from 5° to 30°. As can be appreciated, the angle 36 can alternatively be represented with regard to other reference lines or planes without departing from the spirit of this disclosure. As an example, the angle 36 can be represented as an angle of inclination with respect to the axis A (i.e., [90°-angle 36]). Thus, the angle of inclination can be greater than 45°. In further examples, the angle of inclination can be greater than or equal to 60°, or from 60° to 85°.

Figure 3:
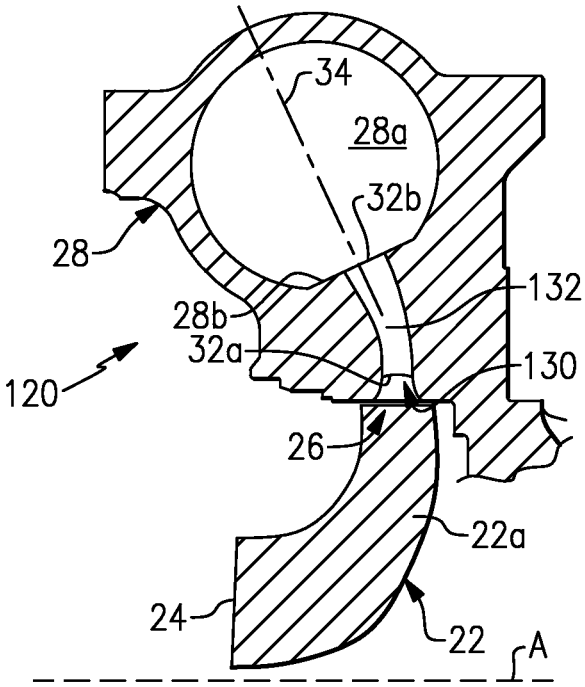
FIG. 3 illustrates another example turbopump that includes a vane that diverges.

FIG. 3 illustrates another example turbopump 120. In this disclosure, like reference numerals designate like elements where appropriate and reference numerals with the addition of one-hundred or multiples thereof designate modified elements that are understood to incorporate the same features and benefits of the corresponding elements. In this example, the passage 130 and the vane 132 diverge. For example, the vane 132 diverges from the leading edge 32*a* to the trailing edge 32*b*. The divergence facilitates diffusing the fluid as it exits the impeller 22.

The curvature of the vane 32/132 reduces axial length of the turbopump 20/120, yet still provides good fluid dynamic performance. The reduced axial length also reduces weight and provides better rotor dynamic margin. Additionally, the flat side 28*b* that is flush with the trailing edge 32*b* at the vane 32 facilitates the shifting of stresses away from the fillets of the vane 32/132, thus reducing stress in the vane 32. The flat side 28*b* may also guide stresses in the discharge collector 28 to be more normal to the vane 32.

Although a combination of features is shown in the illustrated examples, not all of them need to be combined to realize the benefits of various embodiments of this disclosure. In other words, a system designed according to an embodiment of this disclosure will not necessarily include all of the features shown in any one of the figures or all of the portions schematically shown in the figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A turbopump comprising:

an impeller rotatable about an axis, wherein the impeller has an axial inlet;

a discharge collector;

a passage having an inlet face at which the passage opens to the impeller and an outlet face at which the passage opens to the discharge collector; and a vane extending in the passage, the vane is curved axially forward in the direction of the axial inlet, and wherein the vane includes a leading edge at the impeller, a trailing edge that protrudes past the outlet face and extends into the discharge collector, and a height that is uniform from the leading edge to the trailing edge.

2. The turbopump as recited in claim 1, wherein the discharge collector has a flat side, and the passage opens into the discharge collector at the flat side.

3. The turbopump as recited in claim 2, wherein the discharge collector has a symmetry with respect to a line of symmetry that intersects the vane.

4. The turbopump as recited in claim 1, wherein there is a radial direction perpendicular to the axis, and the vane is curved up to 45° with respect to the radial direction.

5. The turbopump as recited in claim 1, wherein the vane is a guide vane.

6. A turbopump comprising:

an impeller that is rotatable about an axis;

a discharge collector radially outwards of the impeller;

a passage having an inlet face at which the passage opens to the impeller and an outlet face at which the passage opens to the discharge collector; and a vane in the passage, the vane includes, relative to the axis, a radially inner leading edge at the inlet face and a radially outer trailing edge that protrudes past the outlet face and extends into the discharge collector, and the radially outer trailing edge is axially forward relative to the radially inner leading edge, wherein the vane includes a height that is uniform from the radially inner leading edge to the radially outer trailing edge.

7. The turbopump as recited in claim 6, wherein the radially outer trailing edge is axially offset from the radially inner leading edge by up to 45° with regard to respective references points and lines at midpoints of the radially outer trailing edge and the radially inner leading edge.

8. The turbopump as recited in claim 6, wherein the radially outer trailing edge is axially offset from the radially inner leading edge by equal to or less than 30° .

9. The turbopump as recited in claim 6, wherein the discharge collector has a flat side, and the passage opens into the discharge collector at the flat side.

10. A turbopump comprising:

an impeller rotatable about an axis;

a discharge collector;

a passage having an inlet face at which the passage open to the impeller and an outlet face at which the passage opens to the discharge collector; and a vane extending in the passage, the vane is axially inclined relative to the axis, and wherein the vane includes a leading edge at the impeller, a trailing edge that protrudes past the outlet face and extends into at the discharge collector, and a height that is uniform from the leading edge to the trailing edge.

11. The turbopump as recited in claim 10, wherein the vane is inclined at an angle of inclination of greater than 45° .

12. The turbopump as recited in claim 10, wherein the impeller has an inlet side, and the vane is inclined toward the inlet side.

13. The turbopump as recited in claim 1, wherein the vane defines axially forward and aft sides that have a constant curvature and do not have any corners.

* * * * *